US006684424B2

(12) United States Patent
Jehn

(10) Patent No.: US 6,684,424 B2
(45) Date of Patent: Feb. 3, 2004

(54) VETERINARY GURNEY

(76) Inventor: Frank Jehn, 2190 Rte. 9, Unit D2, Toms River, NJ (US) 08753

( * ) Notice: Subject to any disclaimer, the term of this patent is extended or adjusted under 35 U.S.C. 154(b) by 0 days.

(21) Appl. No.: 10/211,140

(22) Filed: Aug. 2, 2002

(65) Prior Publication Data

US 2003/0033672 A1 Feb. 20, 2003

Related U.S. Application Data

(60) Provisional application No. 60/313,346, filed on Aug. 20, 2001.

(51) Int. Cl.[7] ..... A61G 1/013
(52) U.S. Cl. ..... 5/611; 5/11; 5/86.1
(58) Field of Search ..... 5/611, 11, 86.1, 5/81.1 R; 296/20

(56) References Cited

U.S. PATENT DOCUMENTS 5,022,105 A * 6/1991 Catoe ..... 5/11
5,575,026 A * 11/1996 Way et al. ..... 5/611 X

* cited by examiner

*Primary Examiner*—Heather Shackelford
*Assistant Examiner*—Sunil Singh
(74) *Attorney, Agent, or Firm*—Clifford G. Frayne

(57) ABSTRACT

A mobile veterinary gurney having a base frame member supporting a plurality of wheels, an elevation scissor frame member mounted on the base frame, and a gurney table mounted on the elevation scissor frame, there being mounted on the elevation scissor frame member a manually actuated, pressurized gas cylinder cooperative with the base frame member for controlling the opening and closing of the elevation scissor frame member and allowing the elevation of the gurney table to be locked at a selected height.

2 Claims, 5 Drawing Sheets

VETERINARY GURNEY

RELATED APPLICATIONS

Applicant claims the benefit of provisional application Serial No. 60/313,346 filed Aug. 20, 2001.

BACKGROUND OF THE INVENTION

1. Field of the Invention

The present invention relates to gurneys and in particular to a veterinary gurney which is actuated by means of a pressurized, lockable gas cylinder to allow the user to adjust to any selected height between fully collapsed and fully extended for the transport, transfer or examination of an animal.

2. Description of the Prior Art

Gurneys are well known in the prior art for the transfer of humans from an accident scene to an ambulance to a hospital or emergency room. Gurneys are also used in the veterinary science to transfer animals within the veterinary such as from a cage to the operating table or vice versa. The human structure being somewhat standard as to shape, yet varying in size, gurneys for human use are somewhat standardized. The veterinarian however treats animals of varying size, shape and weight. Therefore the veterinary gurney must easily accommodate various size animals and must also be able to be positioned at a selected height to transfer animals and be collapsible for storage when not in use. In a veterinary clinic, animals may be housed or recuperate in cages or enclosures of varying heights from the floor. They may also be treated at various locations within the veterinary which are at different heights. It is therefore an advantage to be able to adjust the table top associated with the gurney to this preselected height.

Gurneys presently in use use a scissors-like lever action to raise the gurney table vertically and a series of mechanical stops to lock it at preselected heights. However, the mechanical stops used in the gurneys of the present art are not fully adjustable to any height, but rather only to those preset heights dictated by the settings of the mechanical stops. Still further the present gurney tables must be manually lifted and positioned to the preset heights.

OBJECTS OF THE INVENTION

An object of the present invention is to provide for a novel veterinary gurney which can be locked at infinitely selectable heights between the fully collapsed position and the fully extended position.

Another object of the present invention is to provide for a novel veterinary gurney in which the gurney table is aided in elevation by means of a pressurized, lockable gas cylinder.

A still further object of the present invention is to provide for a novel veterinary gurney in which gas pressure elevation lock is available to the gurney table from the fully collapsed position to the maximum extension of the table.

A still further object of the present invention is to provide for a novel veterinary gurney in which the gas pressure assisted elevation is finger actuated, which is more convenient and user friendly than other mechanical locking systems.

SUMMARY OF THE INVENTION

A mobile veterinary gurney having a base frame member supporting a mobility means, an elevation scissor frame member mounted on the base frame, and a gurney table mounted on the elevation scissor frame, there being mounted on the elevation scissor frame member a manually actuated, pressurized gas cylinder cooperative with the base frame member for controlling the opening and closing of the elevation scissor frame member and allowing the elevation of the gurney table to be locked at a selected height.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
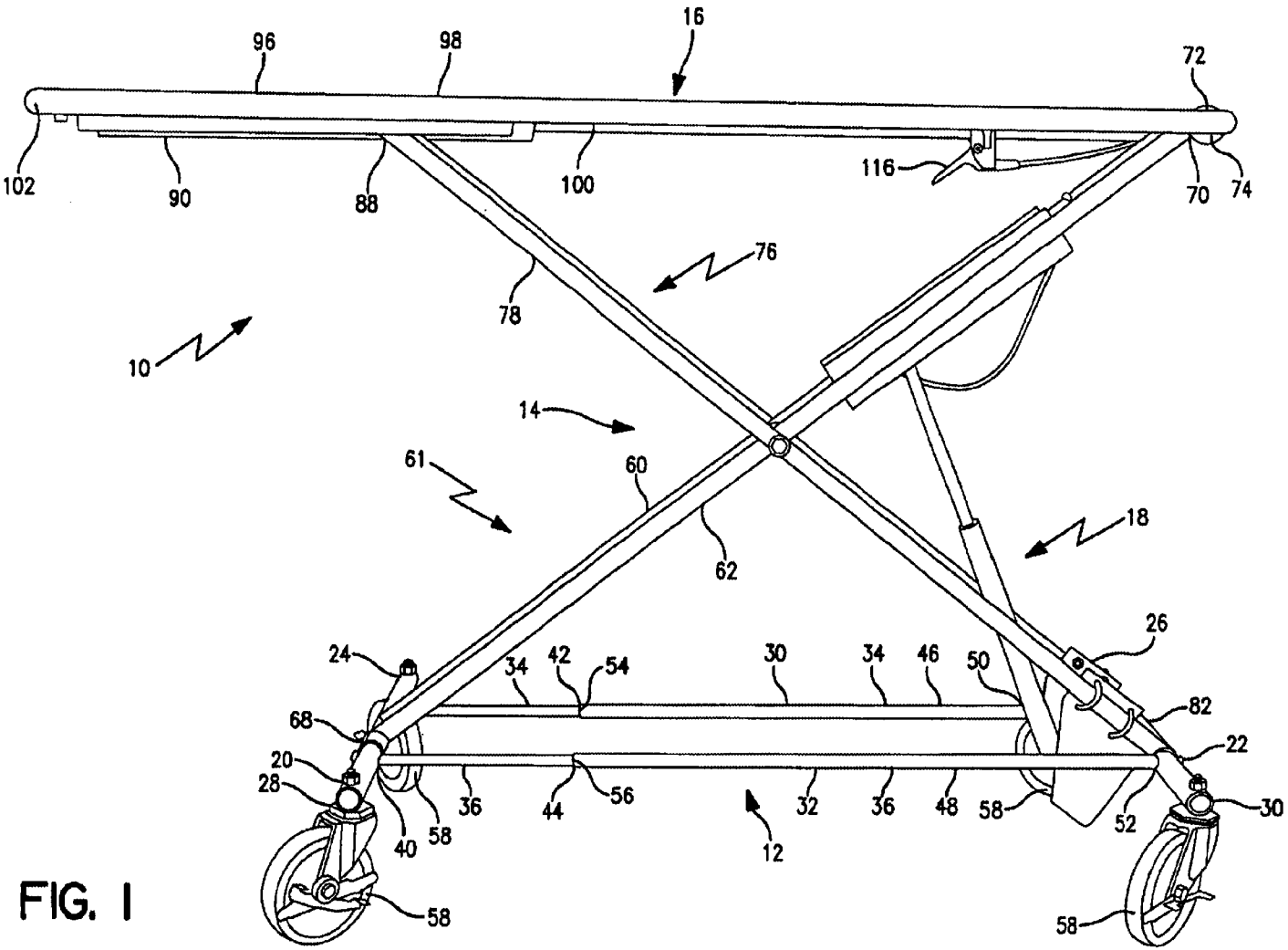
FIG. 1 is a side view of the veterinary gurney of the present invention.
Figure 3:
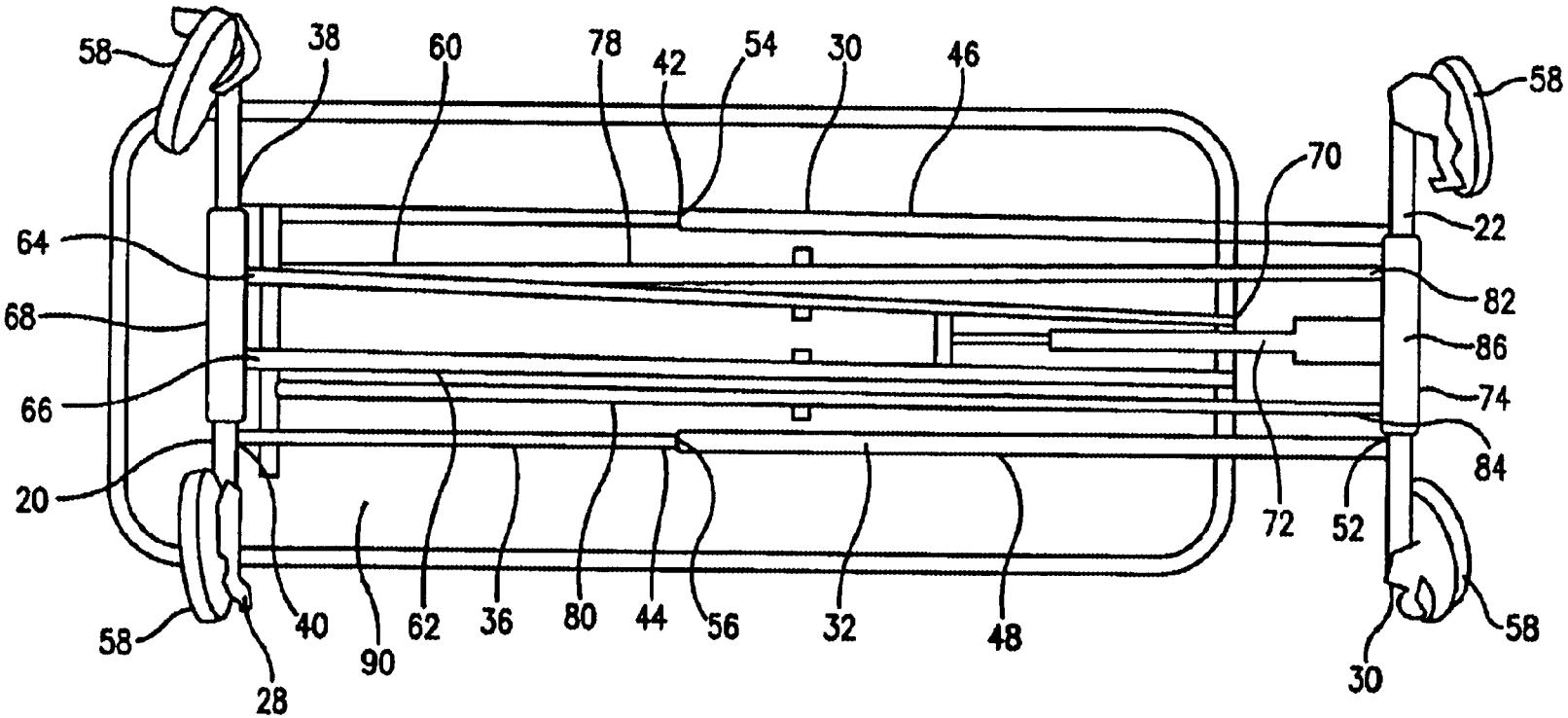
FIG. 3 is a bottom view of the veterinary gurney of the present invention in a semi-collapsed configuration.

FIG. 1 is a side view of the veterinary gurney 10 of the present invention and FIG. 3 is a bottom view. The veterinary gurney 10 of the present invention comprises four main elements; a base frame 12, a scissor frame 14, a gurney table member 16, and an elevational assist and lock member 18.

Base frame member 12 is constructed of two parallel, spaced apart axle members 20 and 22 having first ends 24 and 26 respectively, and second ends 28 and 30. Parallel spaced apart axle members 20 and 22 are secured together by means of two parallel extender rods 30 and 32 comprised of a first tube 34 and 36 having a first end 38 and 40 secured to spaced apart axle member 20 and a second end 42 and 44 slidably receivable within a second tube 46 and 48 having first ends 50 and 52 secured to opposing axle 22 and second ends 54 and 56 conforming to the outer diameter of first tubes 34 and 36 for the slidable receipt of telescoping therein. Secured at the ends of parallel spaced apart axle members 20 and 22 are swivel lock wheels 58, which provide mobility to the veterinary gurney 10.

Scissor frame 14 is comprised of a first frame member 61 having two tubular members 60 and 62 in fixed parallel relationship. First ends 64 and 66 of tubular members 60 and 62 are secured to a cross tube 68, the inner diameter of which is dimensioned to the outer diameter of parallel spaced apart axle member 20 so as to allow for the rotatability of cross tube 68 on axle member 20. Cross tube 68 is positioned on axle member 20 between extender rods 30 and 32. The second ends 70 and 72 of the first frame member are secured to a second cross tube 74 which is rotatably securable to the gurney table as more fully discussed hereafter.

Second scissor frame member 76 is comprised of two parallel fixed tubes 78 and 80, the first ends 82 and 84 of parallel fixed tubes 78 and 80 being secured to a cross tube 86 which is rotatably mounted on axle member 22 between extender rods 30 and 32. The second ends of parallel fixed tubes 78 and 80 of second scissor frame member 76 are secured to a cross tube 88 which is slidably receivable within a track guide 90 (FIGS. 2 and 5) mounted on the underside of gurney table member 16.

The gurney table member 16 comprises a rigid planar member 96 having an upper surface 98 and a lower surface

100, the gurney table top being mounted to a tubular frame 102 about the gurney table member periphery.

Figure 5:
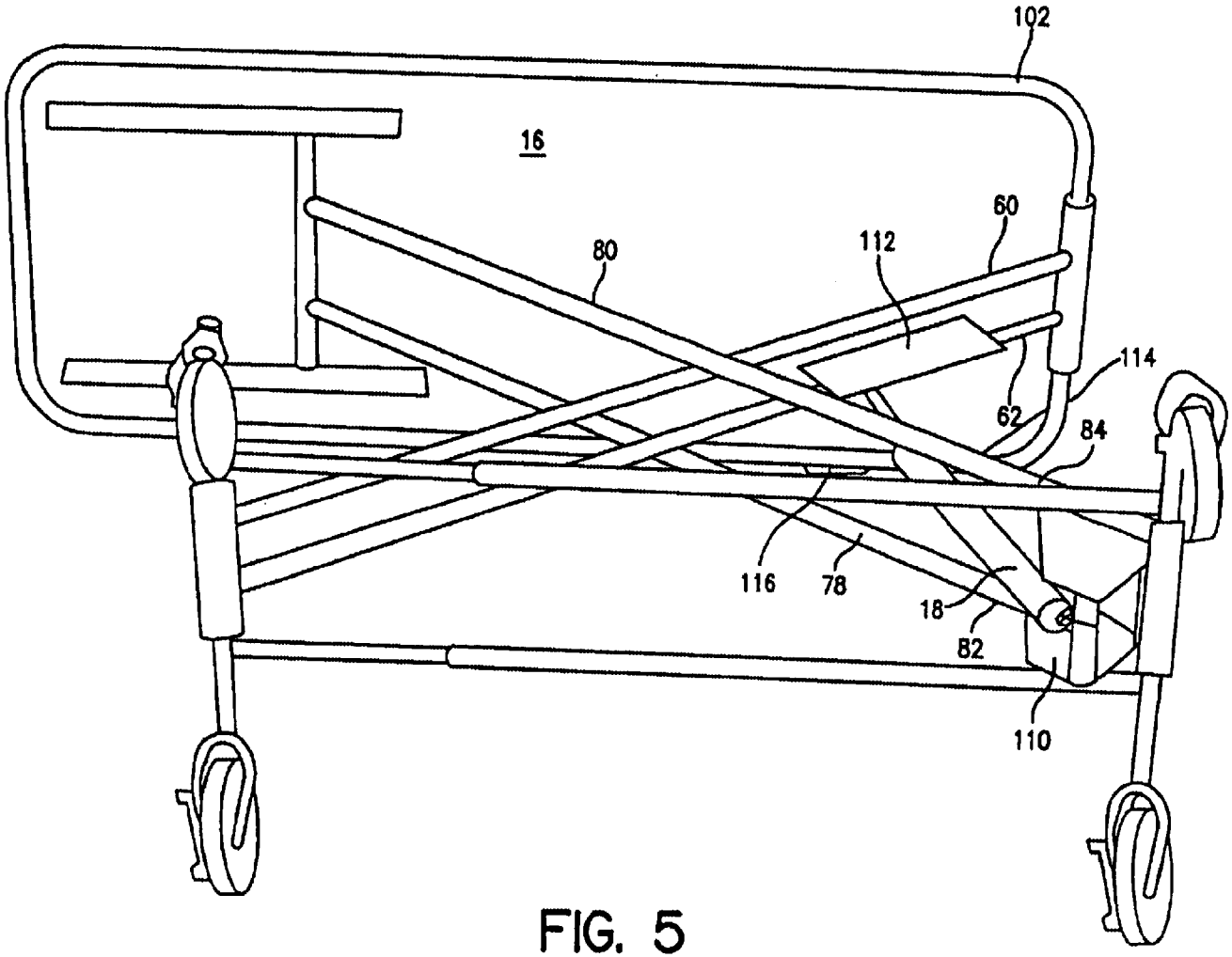
FIG. 5 is a perspective bottom view of the veterinary gurney of the present invention in an extended position.

Referring to FIG. 5 which is a prospective bottom view of the gurney table 10, there is secured between first ends 82 and 84 of parallel fixed tubes 78 and 80 which comprise second scissor frame member 76, a bracket 110. Another bracket 112 with a cross member is also secured between tubular members 60 and 62 which comprise first scissor frame member 61. Attached to these two brackets is the elevational assist member 18 comprising a pressurized gas cylinder 114. Pressurized gas cylinder 114 is in communication with a toggle switch 116 (FIG. 1) mounted on the edge of tubular frame 102 about gurney table member 16. It will be noted and more fully explained hereafter that the first end 118 of gas pressurized cylinder 114 is secured to bracket 110 at a point which is lower than base frame member 12. FIG. 3 which is a bottom view of the veterinary gurney table 10 illustrates the gurney table in the collapsed position. In operation, the user would activate toggle switch 116 which would in turn activate gas pressurized cylinder 114. The user would then lift up the gurney table from one side being assisted by the gas pressurized cylinder. This would cause the scissor frame 14 to open thus elevating the gurney table member 16 to a desired height at which time the toggle switch 116 would be released and the height of the table would be locked and held by gas pressurized cylinder 114. By positioning the first end 118 of gas pressurized cylinder 114 lower than base frame 12, the user is insured that the gas pressurized cylinder 114 maintains an angle with respect to first scissor frame member 61 such that it is available for assisting the raising of the gurney table member 16 from the collapsed position to full extension. The height of the gurney table 10 is lowered by activating toggle switch 116 thereby unlocking the gas pressurized shock 114 and having the user press down on the gurney table member 16 until the desired height is achieved and thence release the toggle switch.

Figure 2:
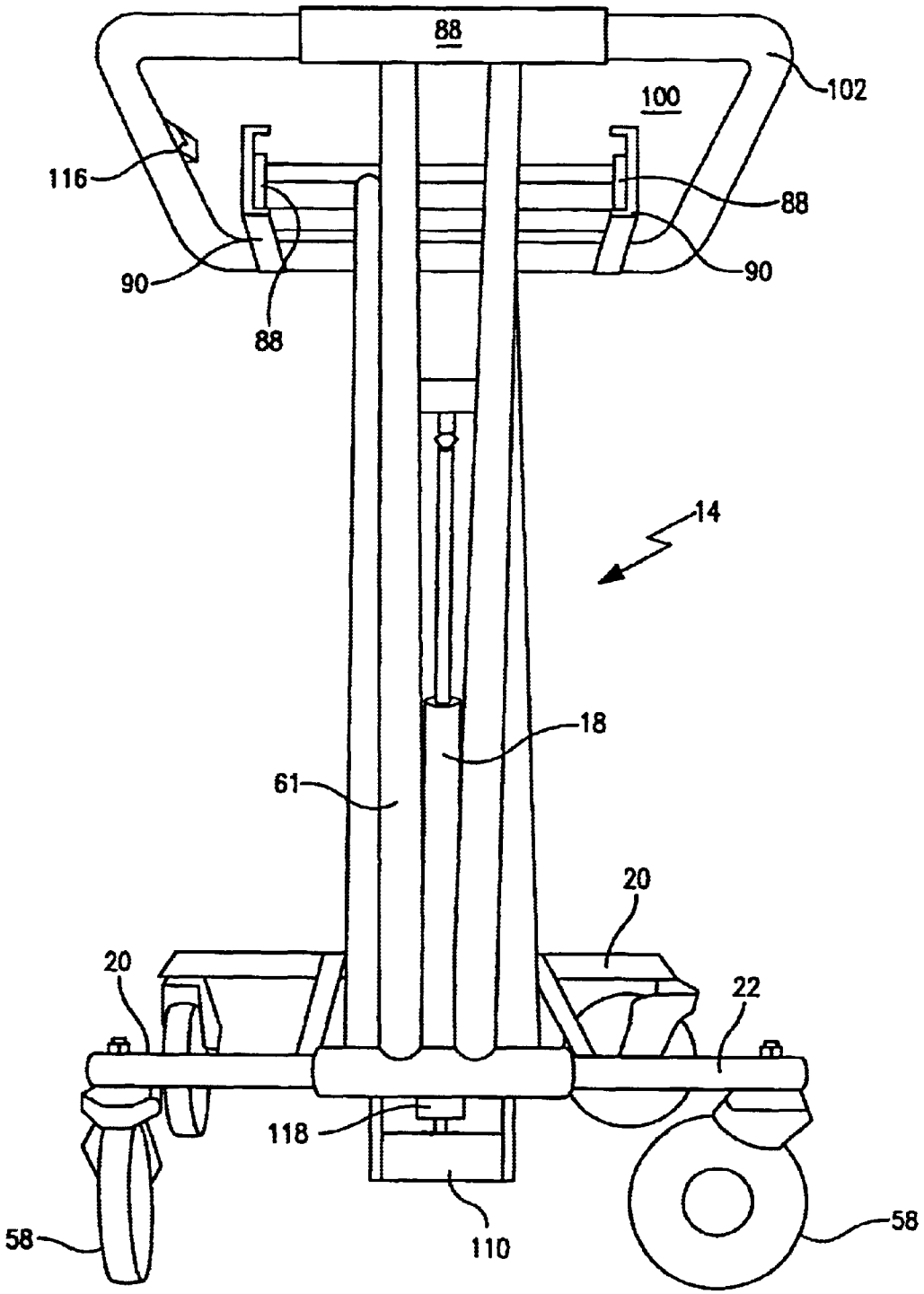
FIG. 2 is an end view of the veterinary gurney of the present invention.
Figure 4:
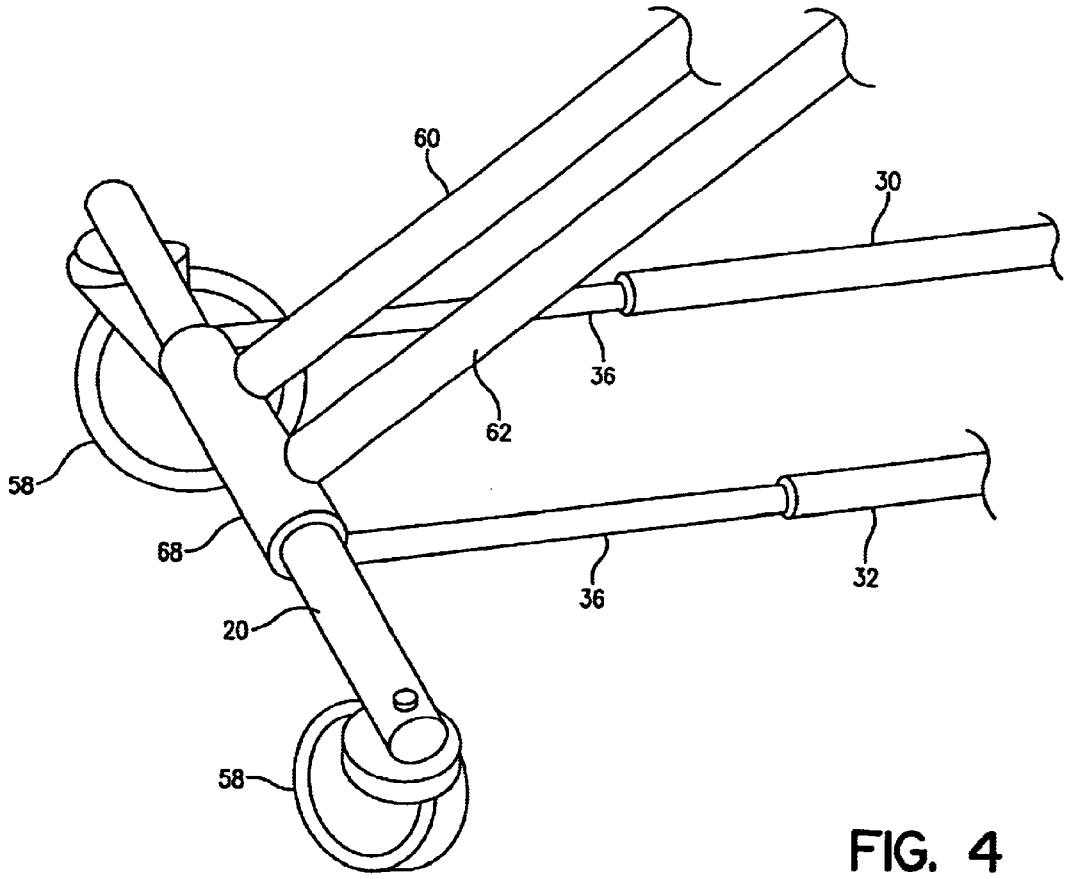
FIG. 4 is a perspective view of the scissor frame/base frame connection of the veterinary gurney of the present invention.

FIG. 2 is an end view of the gurney table more clearly illustrating some of the elements discussed thus far and FIG. 4 is a perspective close up view of first scissor frame member 61 and its positioning on axle 22.

While the present invention has been described with respect to the preferred embodiment thereof, it will be recognized by those of ordinary skill in the art that many changes and modifications may be made without departing from the spirit and scope of the invention.

I claim:

1. A gurney for the transport of a human or animal, the height of said gurney selectively adjustable to a height between fully collapsed to fully extended, said gurney comprising:

a horizontal support having a first end, a second end, an upper support surface and a lower support surface, said lower support surface having a pair of parallel disposed rails proximate said first end;

a base frame having a first axle member and a second axle member in parallel, spaced apart relationship, said first axle member disposed beneath said first end of said horizontal support, said second axle member disposed beneath said second end of horizontal support, said first and second axle members having a pair of wheels swivelly mounted thereon, there being disposed between said two spaced apart axle members, two parallel, spaced apart telescoping extender rods, the opposing ends of which are secured to said first and second axle members;

an elevational scissor frame rotatably secured to said base frame and fixedly and slidably mounted to said horizontal support, said scissor frame comprising a rotatable sleeve member mounted on each said axle member, a first pair of arms parallelly disposed having first ends secured to said sleeve member on said first axle member and a second ends fixedly secured to said lower surface of said horizontal support at said second end of said horizontal support;

a second pair of arms parallelly disposed having first ends secured to said sleeve member on said second axle member and a second ends secured to a cross member slidably engagable between said parallelly disposed rails on said lower surface of said horizontal support, said first and second arms pivotally secured at their midpoint;

elevational and locking means mounted to said base member and between said second pair of arms of a scissor means, in communication with said first pair of arms providing means for elevation to selected height, locking at a selected height and means for collapse, said elevational and locking means comprises a pressurized cylinder activated by a power activation means positioned on said lower support surface of said horizontal support, said pressurized cylinder is secured to said base frame below said second axle member to permit collapse of said gurney.

2. The gurney in accordance with claim 1 wherein said telescoping extender rods of said base frame comprise two parallelly disposed tubular members secured to said first axle member and a second pair of tubular members slidably receivable within said parallelly diposed tubular members and secured to said second axle member.

* * * * *